US008950098B2

(12) United States Patent
Sims et al.

(10) Patent No.: US 8,950,098 B2
(45) Date of Patent: Feb. 10, 2015

(54) SHOCK, MUZZLE JUMP, AND FELT RECOIL REDUCERS FOR HANDGUNS

(76) Inventors: Steven C. Sims, Shelton, WA (US); George Clark, Lacey, WA (US); Jonathan F. Sell, Shelton, WA (US); Gary Sims, Shelton, WA (US); Greg Winters, Shelton, WA (US)

( * ) Notice: Subject to any disclaimer, the term of this patent is extended or adjusted under 35 U.S.C. 154(b) by 0 days.

(21) Appl. No.: 12/932,216

(22) Filed: Feb. 18, 2011

(65) Prior Publication Data

US 2011/0258900 A1 Oct. 27, 2011

Related U.S. Application Data

(60) Provisional application No. 61/338,494, filed on Feb. 19, 2010.

(51) Int. Cl.
*F41C 23/08* (2006.01)
*F41C 23/10* (2006.01)

(52) U.S. Cl.
CPC ..... *F41C 23/08* (2013.01); *F41C 23/10* (2013.01)
USPC ..... 42/71.02; 42/1.06

(58) Field of Classification Search
USPC ..... 42/71.01, 71.02, 1.06; 81/22
See application file for complete search history.

(56) References Cited

U.S. PATENT DOCUMENTS

| | | | | |
|---|---|---|---|---|
| 1,049,739 | A * | 1/1913 | Leach | 42/71.02 |
| 4,068,742 | A * | 1/1978 | Resare | 188/322.5 |
| 4,936,036 | A * | 6/1990 | Sniezak et al. | 42/71.02 |
| 5,018,733 | A * | 5/1991 | Buand | 473/550 |
| D351,448 | S * | 10/1994 | Fisher | D22/108 |
| 6,338,290 | B1 * | 1/2002 | Lin | 81/22 |
| 7,748,153 | B2 * | 7/2010 | Beretta | 42/71.02 |
| 2010/0071244 | A1 * | 3/2010 | Fitzpatrick et al. | 42/71.01 |

* cited by examiner

*Primary Examiner* — Daniel J Troy
(74) *Attorney, Agent, or Firm* — Wells St. John, PS

(57) ABSTRACT

Slip-on handgun grips which contribute to accuracy and speed of target acquisition and make shooting a handgun a more pleasant experience by providing a comfortable, secure grip; and by isolating a shooter's thumb from impact and reducing shock, muzzle jump, twist, and recoil when the handgun is fired. The grip is fabricated from a stretchable elastomeric material. This material plus breakaway technology, external grooving, and a thumb-isolating tab maximize the enumerated benefits.

10 Claims, 3 Drawing Sheets

SHOCK, MUZZLE JUMP, AND FELT RECOIL REDUCERS FOR HANDGUNS

REFERENCE TO A RELATED APPLICATION

The benefit of provisional patent application No. 61/338,494 filed 19 Feb. 2010 is claimed.

TECHNICAL FIELD OF THE INVENTION

The present invention relates to novel, improved, elastomeric handgun grips.

BACKGROUND OF THE INVENTION

A number of U.S. patents disclose elastomeric handgun grips.

Those known to applicants are:

| Pat. No. | Patentee(s) | Issue Date |
|---|---|---|
| 1,049,789 | Leach, Jr. | 7 Jan. 1913 |
| 3,672,084 | Pachmayr | 29 Jun. 1972 |
| B1 3758978 | Theodore | 8 Nov. 1988 |
| 3,815,270 | Pachmayr | 11 Jun. 1974 |
| 4,043,066 | Pachmayr et al. | 23 Aug. 1977 |
| 4,132,024 | Pachmayr et al. | 2 Jan. 1979 |
| 4,148,149 | Pachmayr et al. | 10 Apr. 1979 |
| 4,286,401 | Pachmayr et al. | 1 Sep. 1981 |
| 4,359,833 | Pachmayr et al. | 23 Nov. 1982 |
| 4,378,651 | Pachmayr et al. | 5 Apr. 1983 |
| 4,833,812 | Farrar | 30 May 1989 |
| 4,998,367 | Leibowitz | 12 Mar. 1991 |
| 5,406,731 | Stevens | 18 Apr. 1995 |
| 5,615,505 | Vaid | 1 Apr. 1997 |
| 5,857,279 | de Oliveria Masino | 12 Jan. 1999 |
| 6,860,053 | Christiansen | 1 Mar. 2005 |
| Des. 351448 | Fisher | 11 Oct. 1994 |
| Des. 351638 | Scott et al. | 18 Oct. 1994 |
| Des. 487298 | Clare et al. | 2 Mar. 2004 |

None of the devices disclosed in the foregoing patents are designed to reduce shock, muzzle jump, or felt recoil when the handgun equipped with the device is fired.

SUMMARY OF THE INVENTION

Disclosed and claimed herein are novel handgun grips which are improvements over those disclosed in the above-cited prior art in that they are specifically designed to provide a secure grip and to make a handgun more comfortable to shoot by reducing shock, muzzle jump, and recoil when a handgun equipped with such a grip is fired. Among the features which further these objectives are an ear (or tab) which protects the shooter's thumb when the gun is fired, external grooving, and inner side, breakaway nodes at the rear of the grip.

DETAILED DESCRIPTION OF THE INVENTION

Figure 1:
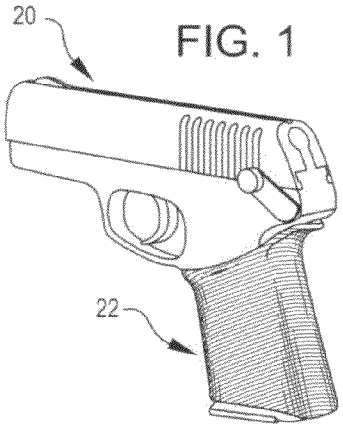
FIG. 1 is a pictorial view of a pistol equipped with a grip embodying the principles of the present invention.
Figure 2:
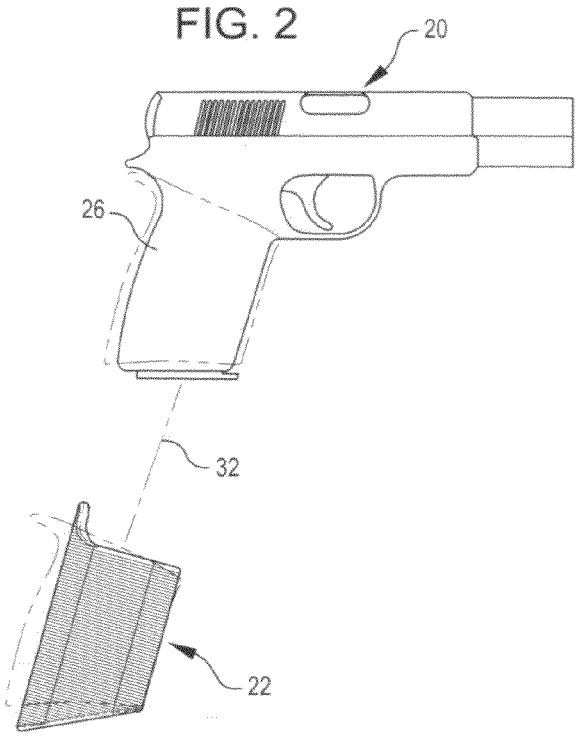
FIG. 2 is an exploded view of the FIG. 1 pistol and grip.
Figure 3:
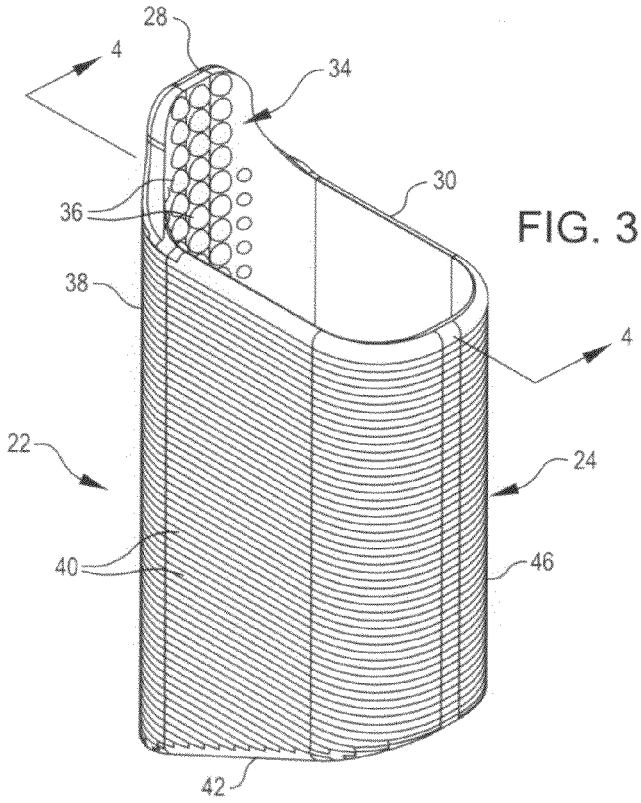
FIG. 3 is a perspective view of the FIG. 1 grip.
Figure 4:
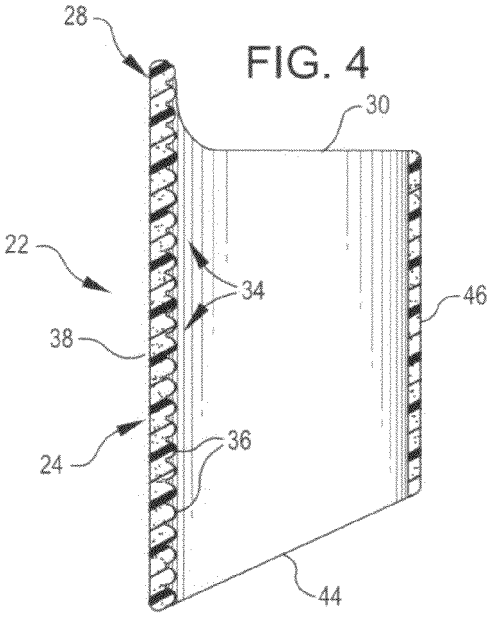
FIG. 4 is a section through the FIG. 1 grip, taken substantially along line 4-4 of FIG. 3.
Figure 5:
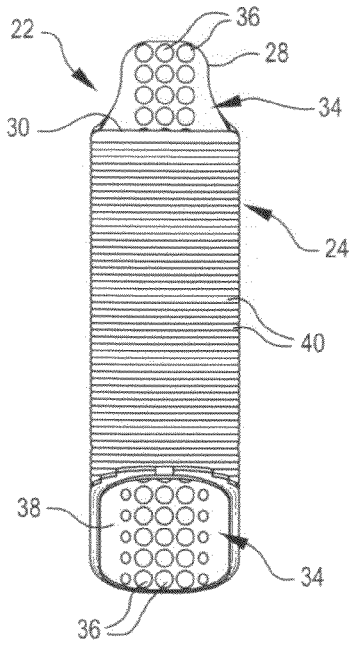
FIG. 5 is a rear end view of the FIG. 1 grip.
Figure 6:
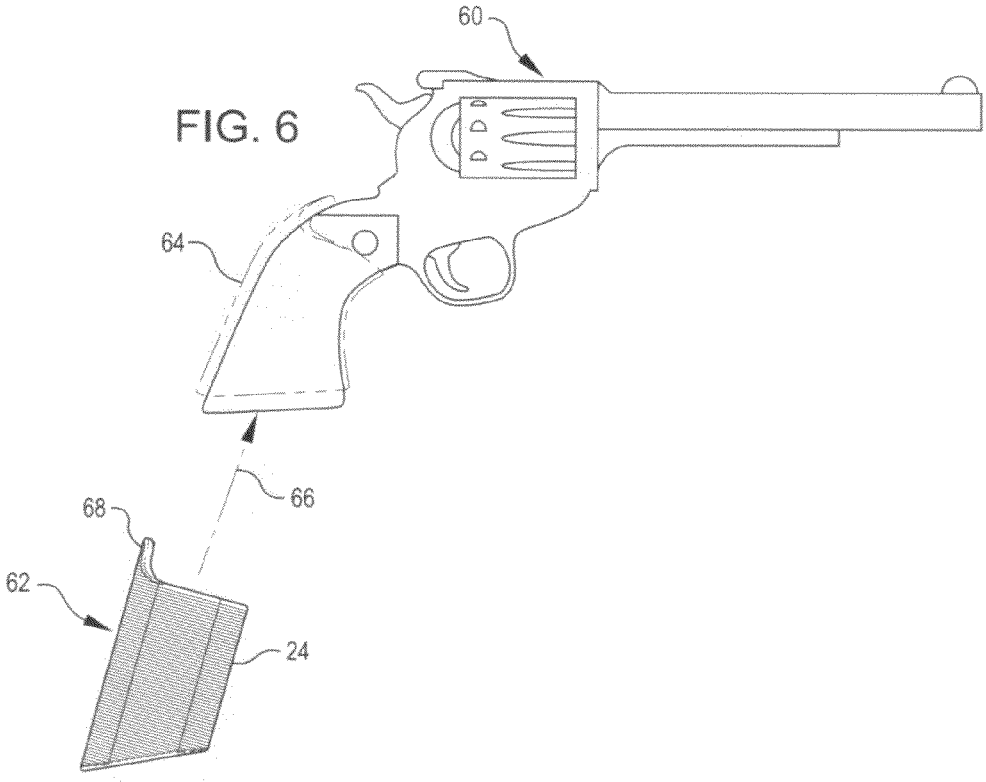
FIG. 6 is an exploded view of a revolver and a grip for that revolver; the grip embodies the principles of the present invention.

Turning now to the drawings, FIG. 1 depicts a pistol 20 equipped with a slip-on grip 22 which is constructed in accord with the principles of the present invention; which provides a comfortable, secure grip; which isolates the shooter's thumb from the pistol's hammer guard; which is capable of reducing shock, muzzle jump, and felt recoil when pistol 20 is fired; and which keeps the pistol from twisting when it is fired, all contributing to accuracy and faster target acquisition.

Grip 22, best shown in FIGS. 2-5, has a sleeve 24, which fits over the butt 26 of pistol 20. An integral tab 28 extends from the upper end 30 of sleeve 24.

Grip 22 is fabricated from a stretchable, elastomeric material such as NAVCOM®. Upon being slipped onto pistol butt 26 (see arrow 32 in FIG. 2), the elastomeric material relaxes, ensuring that grip 22 stays in place. By virtue of its elasticity, grip 22 can be installed on a variety of pistols. For example, a single grip embodying the principles of the present invention fits full-frame semi-automatic, Beretta, FN Herstal, Glock, Heckler & Koch, Magnum Research, Ruger, Sig, and Tauras pistols.

An array 34 of inwardly extending impact nodes 36 is provided on the inner side of the sleeve's rear wall 38. When pistol 20 is fired, these nodes progressively collapse. This tuned progressive resistance, known as break-away technology, provides maximum reduction of felt recoil, minimizing recoil-attributible pain and discomfort and making pistol 20 comfortable to shoot.

Horizontal, non-slip grooving 40 on the exterior surfaces of sleeve 24 side walls 42 and 44, front wall 46, and rear wall 38 keeps shooter's hands from slipping even when grip 22 is wet.

The integral, upstanding tab (or ear) 28 identified above extends over the hammer guard of pistol 20 and protects a shooter's thumb by insulating the thumb from hammer guard contact during recoil, The array of impact nodes 36 extends over the inner side of tab 28 and makes a major contribution to the protective properties of that tab.

Referring still to the drawing, FIGS. 6-9 depict a revolver 60 equipped with a grip 62, which also embodies the principles of the present invention. Grip 62 is similar to above-described pistol grip 22, and it has the same constructions and functions and provides the same benefits. It is installed by slipping it onto the butt 64 of pistol 60 (see arrow 66, FIG. 6).

Components of grips 62 and 22 which have like properties and functions are identified by the same reference characters.

Figure 7:
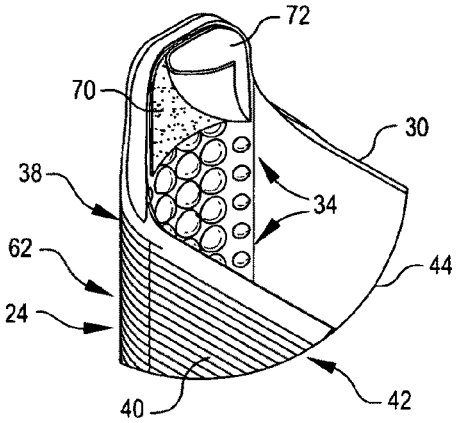
FIG. 7 is a partial perspective of the FIG. 6 grip; shown in this figure is a peel strip partially dislodged to show adhesive provided to secure the grip to the revolver.
Figure 8:
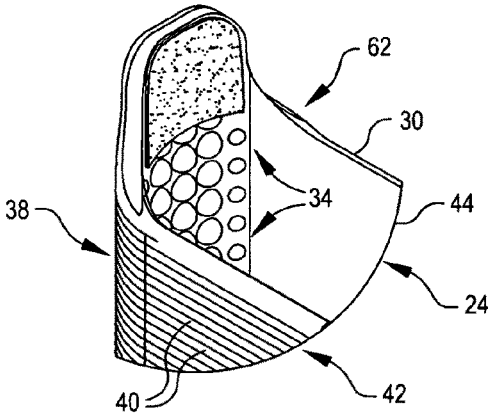
FIG. 8 is a view similar to FIG. 6 but with the peel strip completely removed.

The upstanding tab 68 of revolver grip 62 differs from the corresponding component 28 of pistol grip 22 in that there is a layer 70 of adhesive on the inner side of tab 68 (see FIG. 7). The adhesive layer is covered by a peel strip 72.

Figure 9:
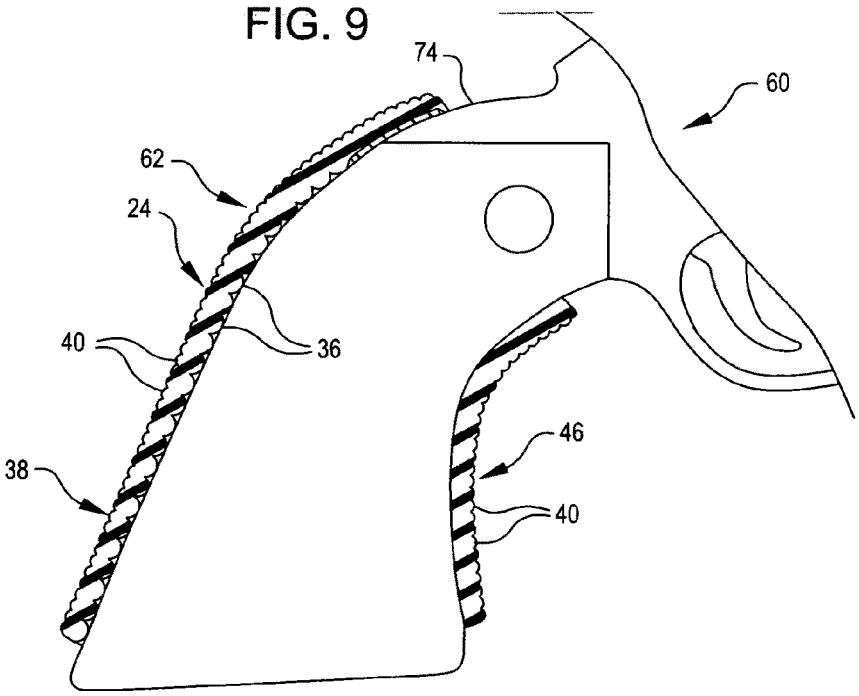
FIG. 9 is a partial side view of the revolver and the grip; the grip is sectioned to show how it fits on and is secured to the revolver.

After grip 62 has been slipped onto pistol butt 64, peel strip 72 is removed (see FIG. 8), and the tab is pressed against the frame 74 of pistol 60 (see FIG. 9). This further insures that grip 62 remains securely in place.

The principles of the present invention may be embodied in forms other than those specifically disclosed above and in the drawings. Therefore, the present embodiments are to be considered in all respects as illustrative and not restrictive, the scope of the invention instead being indicated by the the appended claims rather than by the foregoing description and the drawings; and all changes which come within the meaning and range of equivalency of the claims are therefore intended to be embraced therein.

The invention claimed is:

1. A handgun grip:

which is fabricated from a stretchable elastomeric material; and which comprises a sleeve that can be slipped onto a handgun butt;

the sleeve having a rear wall with an inner side and an outer side, and including an array of nodes on the inner side of the rear wall including two or more horizontally offset nodes and two or more vertically offset nodes, wherein each node has a node width and further wherein the two or more horizontally offset nodes are spaced apart less than one node width apart from one another and the two or more vertically offset nodes are spaced apart less than one node width apart from one another; and wherein the array of nodes is configured for reduction of shock or vibration to a user of the handgun resulting from firing of the handgun.

2. A handgun grip as defined in claim 1 which has an integral, thumb-protecting, upstanding tab extending from the upper end of the sleeve.

3. A handgun grip as defined in claim 1 which has anti-slip scoring on the exterior of the sleeve.

4. The combination of a handgun and a handgun grip as defined in claim 1.

5. A combination as defined in claim 4:

in which the handgun is a pistol; and wherein there is an integral, thumb-protecting, upstanding tab extending from the upper end of the sleeve of the handgun grip.

6. A combination as defined in claim 4:

in which the handgun is a revolver; and wherein there is:

an integral, upstanding tab extending from the upper end of the handgun grip; and a grip-securing adhesive on a handgun-facing side of the tab.

7. A handgun grip as recited in claim 1 and further comprising an integral, thumb-protecting, upstanding tab extending from the upper end of the sleeve.

8. A handgun grip as recited in claim 7 and further wherein the tab includes a plurality of impact nodes configured for reduction of shock or vibration to a user of the handgun resulting from firing of the handgun.

9. A handgun grip:

which is fabricated from a stretchable elastomeric material and which comprises:

a sleeve configured to be slipped onto and completely around a handgun butt, the sleeve including an inner side and an outer side; and an integral, thumb-protecting, upstanding tab extending from the upper end of the sleeve, wherein an inner side of the upstanding tab includes a plurality of impact nodes configured for reduction of shock or vibration to a user of the handgun resulting from firing of the handgun;

wherein each node has a node width and further wherein the plurality of impact nodes are spaced apart less than one node width apart from one another; and wherein the array of nodes is configured for reduction of shock or vibration to a user of the handgun resulting from firing of the handgun.

10. A handgun grip as defined in claim 9 which has anti-slip scoring on the exterior of the sleeve.

* * * * *